US007420534B2

(12) United States Patent
Yamashita et al.

(10) Patent No.: US 7,420,534 B2
(45) Date of Patent: Sep. 2, 2008

(54) DISPLAY APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 862 days.

(21) Appl. No.: 10/441,420

(22) Filed: May 20, 2003

(65) Prior Publication Data

US 2004/0021650 A1 Feb. 5, 2004

(30) Foreign Application Priority Data

May 21, 2002 (JP) ..... 2002-145619

(51) Int. Cl.
*G09G 3/36* (2006.01)

(52) U.S. Cl. ..... 345/100; 345/99

(58) Field of Classification Search ..... 345/100, 345/55, 67, 132, 93, 99
See application file for complete search history.

(56) References Cited

U.S. PATENT DOCUMENTS 5,990,857 A * 11/1999 Kubota et al. ..... 345/98
6,127,998 A * 10/2000 Ichikawa et al. ..... 345/100
6,236,388 B1 * 5/2001 Iida et al. ..... 345/698
6,437,766 B1 * 8/2002 Matsushima et al. ..... 345/98
7,042,433 B1 * 5/2006 Kubota et al. ..... 345/100

* cited by examiner

*Primary Examiner*—Amr Awad
*Assistant Examiner*—Yong Sim
(74) *Attorney, Agent, or Firm*—Robert J. Depke; Rockey, Depke & Lyons, LLC.

(57) ABSTRACT

A vertical driving circuit 5 includes: a shift register 5R having a multistage-connected structure with one stage corresponding to two gate lines G, for transferring a start pulse 2VST inputted to a first stage SR1 thereof and sequentially outputting shift pulses R1 and R2 from respective stages; an intermediate gate circuit unit 5T disposed so as to correspond to each stage of the shift register, for processing a shift pulse of one stage and a shift pulse of a preceding stage and thereby generating temporally separate intermediate pulses A and B in respective stages; and an output gate circuit unit 5U for processing the intermediate pulses A and B and thereby sequentially outputting drive pulses P1 to P4 to four corresponding gate lines G to sequentially select pixels. The shift register 5R includes a dummy additional stage SR0 disposed in front of the first stage SR1 thereof, and a shift pulse R0 outputted from the additional stage is supplied to a first stage NAND1 of the intermediate gate circuit unit, whereby a normal intermediate pulse A is outputted from the first stage of the intermediate gate circuit unit.

16 Claims, 5 Drawing Sheets

DISPLAY APPARATUS

This application claims priority to Japanese Patent Application Number JP2002-145619 filed May 21, 2002 which is incorporated herein by reference.

BACKGROUND OF THE INVENTION

The present invention relates to an active matrix display apparatus typified by an LCD, and particularly to configuration of a vertical driving circuit for driving a pixel array in a form of a matrix.

FIG. 5 is a perspective view of a general configuration of an active matrix display apparatus. As shown in FIG. 5, the conventional display apparatus has a panel structure including a pair of substrates 1 and 2 and a liquid crystal 3 retained between the substrates 1 and 2. A counter electrode is formed on the upper substrate 2. A pixel array unit 4 and a driving circuit unit are formed in an integrated manner on the lower substrate 1. The driving circuit unit is divided into a vertical driving circuit 5 and a horizontal driving circuit 6. Terminals 7 for connection to the outside are formed at an upper end on a periphery of the substrate. The terminals 7 are connected to the vertical driving circuit 5 and the horizontal driving circuit 6 via wiring 8. The pixel array unit 4 has gate lines G and signal lines S formed therein. Pixel electrodes 9 and thin film transistors 10 for driving the pixel electrodes are formed at intersections of the gate lines G and the signal lines S. A pixel P is formed by a combination of a pixel electrode 9 and a thin film transistor 10. The thin film transistor 10 has a gate electrode connected to a corresponding gate line G, a drain region connected to a corresponding pixel electrode 9, and a source region connected to a corresponding signal line S. The gate lines G are connected to the vertical driving circuit 5, whereas the signal lines S are connected to the horizontal driving circuit 6. The vertical driving circuit 5 sequentially selects pixels P via the gate lines G. The horizontal driving circuit 6 writes a video signal to the selected pixels P via the signal lines S.

As definition of LCDs becomes higher, the pixels are reduced in size. With the reduction in size of the pixels, the vertical driving circuit also needs to be reduced in size. The vertical driving circuit generally comprises a multistage-connected shift register, with each stage corresponding to one gate line. By a shift pulse sequentially outputted from each stage of the shift register, the vertical driving circuit selects a pixel row connected to the corresponding gate line on a line-sequential basis. However, since the reduction in size of the pixels decreases an arranging pitch of the gate lines, one stage of the shift register cannot correspond to a space of one pixel corresponding to one gate line.

Accordingly, a vertical driving circuit in which one stage of a shift register is provided for two gate lines has been developed, which is referred to as a decoding type vertical driving circuit. The decoding type vertical driving circuit logically processes a shift pulse outputted from one stage of the shift register and thereby generates drive pulses for two gate lines. The decoding type vertical driving circuit uses a logical gate circuit corresponding to each stage of the shift register to sequentially process the shift pulse according to externally supplied clock pulses. However, a part of the conventionally used logical gate circuit which part corresponds to a first stage of the shift register cannot be made completely the same as parts corresponding to succeeding stages of the shift register, so that a first few pulses are not normal pulses but are irregular drive pulses. Therefore rows of pixels corresponding to a first few gate lines are not selected regularly on a line-sequential basis, and the horizontal driving circuit cannot correctly write a video signal to the first few rows of pixels. Thus a configuration with the conventional decoding type vertical driving circuit uses the first few rows of pixels as dummies to which the video signal is not actually written. However, when the dummy pixel rows are provided, a corresponding effective display area on the substrate is sacrificed, which is a problem to be solved.

SUMMARY OF THE INVENTION

The following means are provided to solve the above problem of the related art. That is, there is provided a display apparatus including: a pixel array unit including a plurality of gate lines, a plurality of signal lines, and pixels arranged in a form of a matrix at intersections of the gate lines and the signal lines; a vertical driving circuit for sequentially selecting the pixels via the gate lines; and a horizontal driving circuit for writing a video signal to the selected pixels via the signal lines, the pixel array unit, the vertical driving circuit, and the horizontal driving circuit being disposed on an identical substrate; wherein the vertical driving circuit includes: a shift register having a multistage-connected structure with one stage corresponding to at least two gate lines, for transferring a start pulse inputted to a first stage thereof and sequentially outputting a shift pulse from each stage; an intermediate gate circuit unit disposed so as to correspond to each stage of the shift register, for processing a shift pulse of a certain stage and a shift pulse of a preceding stage and thereby generating a temporally separate intermediate pulse in each stage; and an output gate circuit unit disposed so as to correspond to each stage of the intermediate gate circuit unit, and operating in response to an externally supplied clock pulse, for processing the intermediate pulse outputted from each stage of the intermediate gate circuit unit and thereby sequentially outputting a drive pulse to two corresponding gate lines to sequentially select pixels. The shift register includes a dummy additional stage disposed in front of the first stage thereof, and a shift pulse outputted from the additional stage is supplied to a first stage of the intermediate gate circuit unit which stage corresponds to the first stage of the shift register, whereby a normal intermediate pulse can be outputted from the first stage of the intermediate gate circuit unit. Further, the output gate circuit unit processes the intermediate pulse outputted from the first stage of the intermediate gate circuit unit and can output a normal drive pulse from a first gate line. Further, the horizontal driving circuit can write a normal video signal from a pixel row corresponding to the first gate line, thus eliminating presence of rows of dummy pixels to which the normal video signal is not written.

The active matrix display apparatus according to the present invention uses the decoding type vertical driving circuit with one stage of the shift register provided for two gate lines. The decoding type vertical driving circuit subjects a shift pulse outputted from one stage of the shift register to gate processing, and thereby generates drive pulses for two gate lines. At this time, by disposing the dummy additional stage in front of the first stage of the shift register, it is possible to form drive pulses having a normal waveform regularly and sequentially from a start. It is thereby possible to write a normal video signal from a start of a video frame and eliminate dummy pixel rows, which have conventionally been required.

According to the present invention, the dummy additional stage is inserted at the front of the shift register included in the decoding type vertical driving circuit, whereby the decoding type vertical driving circuit can sequentially output gate drive pulses all having an equal pulse width from a start of a vertical scan. Consequently, it is possible to coincide a start of writing of a video signal with timing of the gate drive pulse in the first stage, thus enabling driving without dummy pixels. It is thus possible to eliminate a layout area for the dummy pixels and thereby achieve a narrower frame.

DETAILED DESCRIPTION OF THE PREFERRED EMBODIMENT

Figure 1:
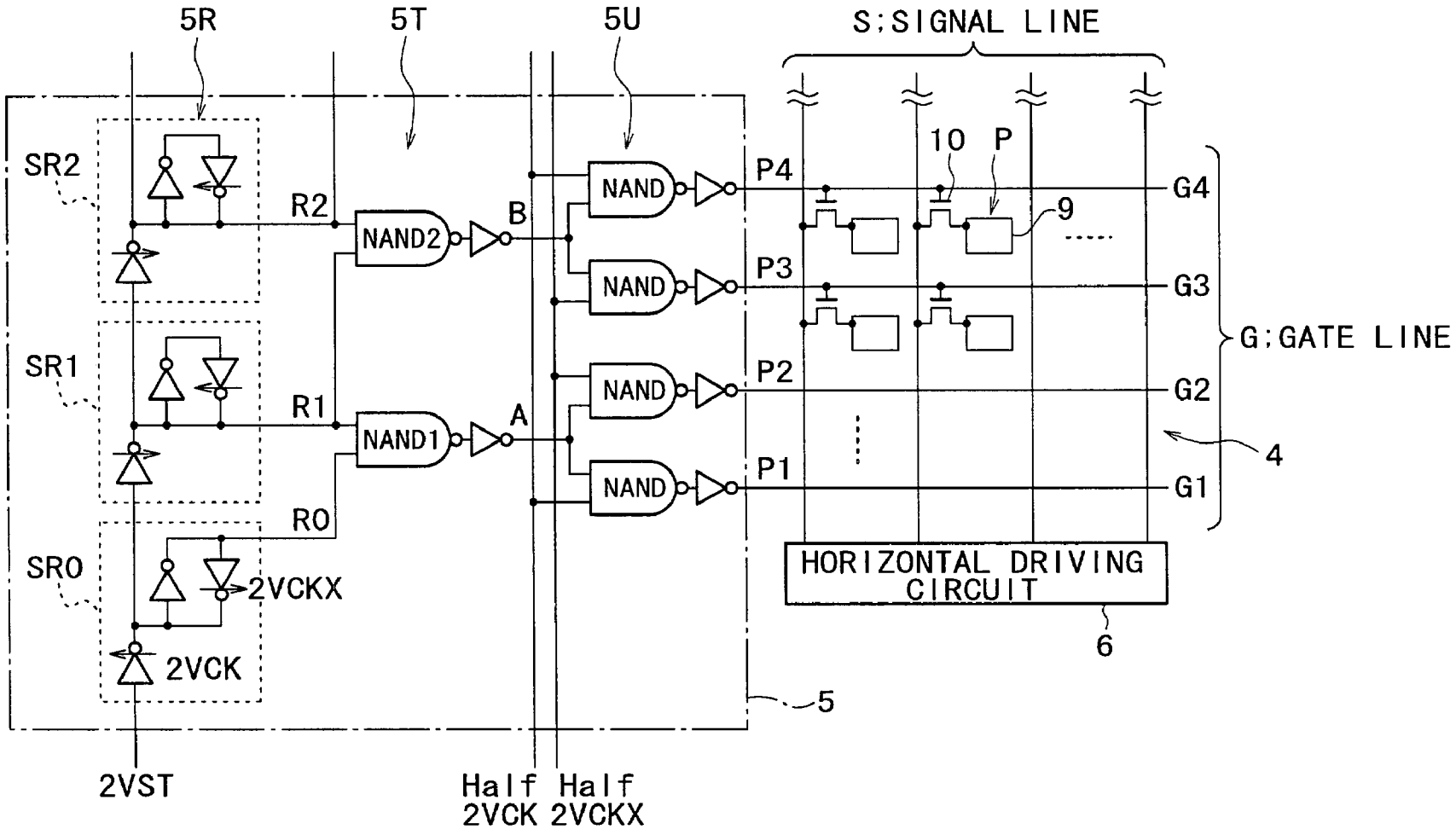
FIG. 1 is a circuit diagram showing a configuration of a display apparatus according to the present invention.

A preferred embodiment of the present invention will hereinafter be described in detail with reference to the drawings. FIG. 1 is a circuit diagram showing a concrete configuration of a display apparatus according to the present invention. As shown in FIG. 1, the display apparatus basically comprises a pixel array unit 4, a vertical driving circuit 5, and a horizontal driving circuit 6, which are all formed on the same substrate in an integrated manner with thin film transistors and the like. The pixel array unit 4 comprises a plurality of gate lines G, a plurality of signal lines S, and pixels P arranged in a form of a matrix at intersections of the gate lines G and the signal lines S. In the present embodiment, a pixel P comprises a pixel electrode 9 and a thin film transistor 10. Incidentally, though not shown, a counter electrode is formed on a surface opposed to the pixel electrode 9, and a liquid crystal, for example, is retained as electro-optical material between the counter electrode and the pixel electrode 9. The thin film transistor 10 has a gate electrode connected to a corresponding gate line G, a source electrode connected to a corresponding signal line S, and a drain electrode connected to the corresponding pixel electrode 9. The vertical driving circuit 5 sequentially selects each of the pixels P via each of the gate lines G. In FIG. 1, in order to facilitate understanding, the vertical driving circuit 5 selects the gate lines G on a line-sequential basis from a bottom to a top of a screen. Specifically, the vertical driving circuit 5 selects a row of pixels P corresponding to a first gate line G1, then selects a row of pixels P corresponding to a second gate line G2, and thereafter sequentially selects pixels P in units of a row. The horizontal driving circuit 6 writes a video signal to the pixels P sequentially selected in units of a row via each of the signal lines S. Thereby a desired image can be displayed on the pixel array unit 4 forming the screen.

The vertical driving circuit 5 has a shift register 5R, an intermediate gate circuit unit 5T, and an output gate circuit unit 5U. One stage of the shift register 5R corresponds to at least two gate lines, and the shift register 5R sequentially outputs a shift pulse from each stage. In the example shown in FIG. 1, one stage SR of the shift register 5R is formed by three inverters. Of the inverters, one is clock-driven by an externally supplied clock pulse 2VCK, and another is clock-driven by an externally inputted clock pulse 2VCKX. The clock pulse 2VCKX is in reverse polarity to the clock pulse 2VCK, and symbol X is used to indicate the reverse polarity. The same applies to other clock pulses. The multistage-connected shift register 5R operates in response to the clock pulses 2VCK and 2VCKX, and sequentially transfers an externally inputted start pulse 2VST to thereby sequentially output shift pulses R1, R2 . . . from respective stages of the shift register 5R. In the example shown in FIG. 1, a first shift register stage SR1 (leading stage) is provided in correspondence with the first two gate lines G1 and G2 to output one shift pulse R1 for the two gate lines G1 and G2. A second shift register stage SR2 is provided in correspondence with next two gate lines G3 and G4 to similarly output a shift pulse R2.

The intermediate gate circuit unit 5T is disposed so as to correspond to each stage of the shift register 5R. The intermediate gate circuit unit 5T processes a shift pulse of a certain stage and a shift pulse of a preceding stage to thereby generate a temporally separate intermediate pulse in each stage. Specifically, in correspondence with the first stage SR1 of the shift register 5R, a first stage of the intermediate gate circuit unit 5T comprises a series connection of a two-input and one-output NAND gate element NAND1 and an inverter. Similarly, in correspondence with the second stage SR2 of the shift register 5R, the intermediate gate circuit unit 5T has a series connection of a NAND gate element NAND2 and an inverter. Directing attention to the second stage, for example, the intermediate gate circuit unit 5T having such a configuration subjects the shift pulse R2 outputted from that stage (second stage SR2) of the shift register 5R and the shift pulse R1 outputted from the preceding stage (first stage SR1) to NAND processing by NAND2 and then inverts the result by the inverter. The intermediate gate circuit unit 5T thereby generates a temporally separate intermediate pulse B in the second stage. The intermediate gate circuit unit 5T performs a similar operation in the first stage to thereby output a temporally separate intermediate pulse A prior to the intermediate pulse B.

The output gate circuit unit 5U is disposed so as to correspond to each stage of the intermediate gate circuit unit 5T. The output gate circuit unit 5U operates in response to externally supplied clock pulses Half 2VCK and Half 2VCKX to process the intermediate pulses A, B . . . outputted from the respective stages of the intermediate gate circuit unit 5T, and then sequentially outputs a drive pulse to two corresponding gate lines G to sequentially select pixels P. The externally supplied clock pulse Half 2VCK is shifted in phase by 90 degrees with respect to the clock pulse 2VCK supplied to the shift register 5R. This is indicated by Half. The clock pulse Half 2VCKX is an inverted signal of Half 2VCK. Specifically, in correspondence with the first stage of the intermediate gate circuit unit 5T, a first stage of the output gate circuit unit 5U comprises a pair of NAND gate elements NAND and a pair of inverters. The intermediate pulse A is supplied from the corresponding stage of the intermediate gate circuit unit to an input terminal to which the pair of NAND gate elements NAND is commonly connected. An input terminal not commonly connected of one NAND is supplied with the clock pulse Half 2VCK. An input terminal not commonly connected of the other NAND is supplied with the clock pulse Half 2VCKX. An output terminal of one of the pair of NAND gate elements NAND outputs a drive pulse P1 to the first gate line G1 via the inverter. The other NAND gate element NAND similarly outputs a drive pulse P2 to the second gate line G2. Similarly, a part of the output gate circuit unit 5U corresponding to the second stage of the intermediate gate circuit unit 5T processes the intermediate pulse B, and sequentially outputs drive pulses P3 and P4 to the two gate lines G3 and G4 to sequentially select pixels P.

As a feature of the present invention, the shift register 5R has a dummy additional stage SR0 disposed in front of the leading stage (first stage) SR1. A shift pulse R0 outputted from the additional stage SR0 is supplied to the first stage (NAND1) of the intermediate gate circuit unit 5T which stage corresponds to the leading stage, whereby a normal intermediate pulse A can be outputted from the first stage. That is, the NAND gate element NAND1 belonging to the first stage of the intermediate gate circuit unit 5T subjects the shift pulse R1 outputted from the corresponding stage SR1 of the shift register 5R and the shift pulse R0 outputted from the preceding stage (additional stage) SR0 to NAND processing, and thereby outputs the intermediate pulse A. The operation of the first stage of the intermediate gate circuit unit 5T is exactly the same as the operation of the second and succeeding stages, so that the normal intermediate pulse A can be outputted at a start of a vertical scan. In other words, the dummy additional stage SR0 is provided to output the first intermediate pulse A properly. The additional stage SR0 is disposed so as to precede the first stage SR1 of the shift register 5R, and therefore first receives the start pulse 2VST. Consequently, the additional stage SR0 first outputs the shift pulse R0, and thereafter the leading stage (first stage) SR1 outputs the shift pulse R1.

The output gate circuit unit 5U processes the intermediate pulse A outputted from the first stage (NAND1) of the intermediate gate circuit unit 5T, and is able to output a normal drive pulse P1 from the first gate line G1. In this case, the horizontal driving circuit 6 can write a normal video signal from a row of pixels P corresponding to the first gate line G1, whereby presence of rows of dummy pixels to which the normal video signal is not written can be eliminated.

Figure 2:
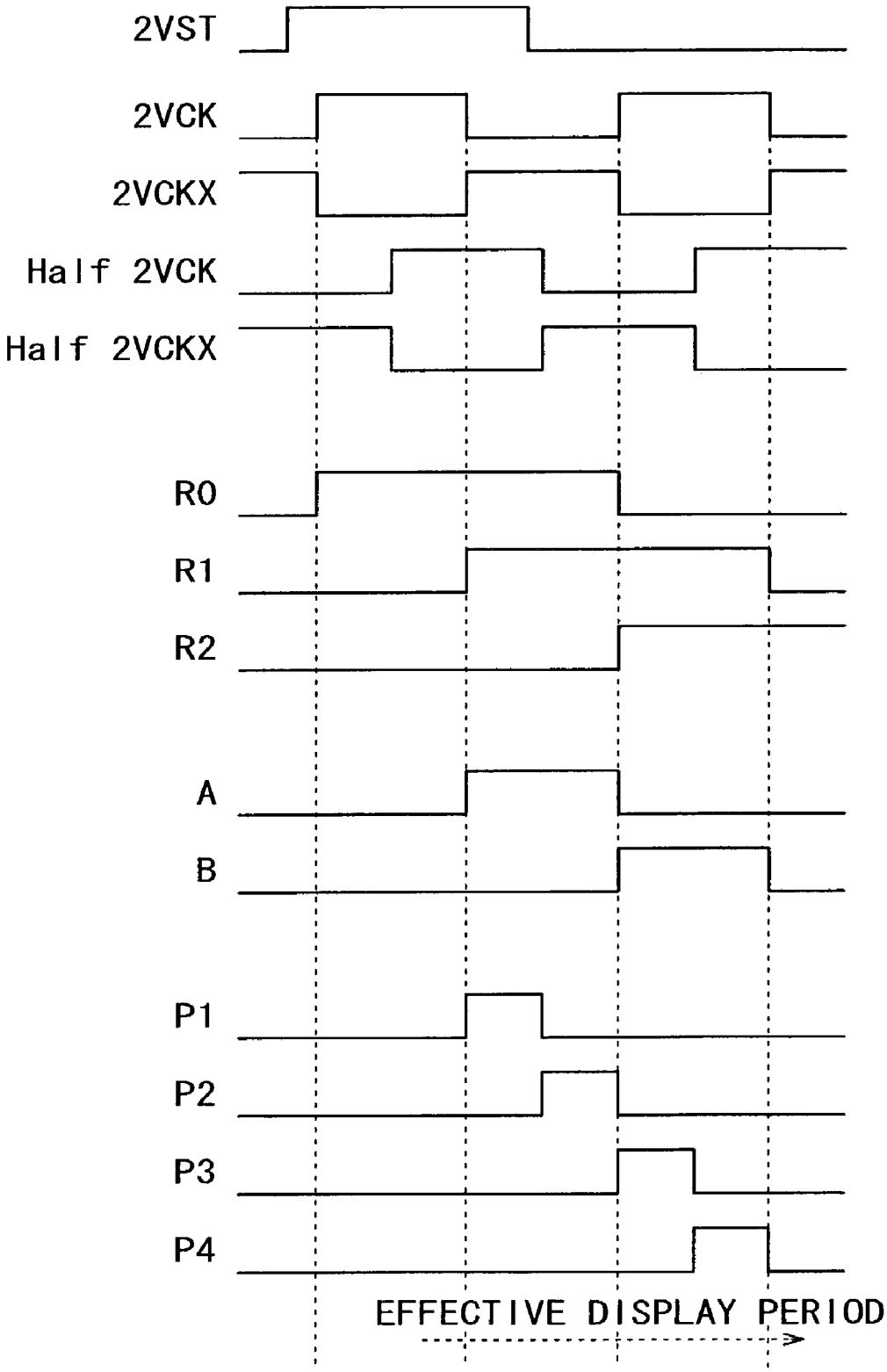
FIG. 2 is a timing chart of assistance in explaining operation of the display apparatus shown in FIG. 1.

Operation of the display apparatus shown in FIG. 1 will be described with reference to a timing chart of FIG. 2. As described above, the vertical driving circuit is externally supplied with the start pulse 2VST and the clock pulses 2VCK, 2VCKX, Half 2VCK, and Half 2VCKX. Of these pulses, 2VST, 2VCK, and 2VCKX are used for operation of the shift register of the vertical driving circuit to generate the shift pulses R0, R1, R2 . . . . The clock pulses Half 2VCK and Half 2VCKX are supplied to the output gate circuit unit of the vertical driving circuit to be used to sequentially generate the drive pulses P1, P2, P3, P4 . . . .

As described above, the shift register sequentially transfers the start pulse 2VST in response to the clock pulses 2VCK and 2VCKX, and outputs the shift pulses R0, R1, R2 . . . from the respective stages. In the present invention, the dummy additional stage is added to the head of the shift register, and hence the additional shift pulse R0 is outputted prior to the first shift pulse R1. The first stage of the intermediate gate circuit unit subjects the shift pulses R0 and R1 to NAND processing and then inverts the result to thereby form the intermediate pulse A. Similarly, the second stage of the intermediate gate circuit unit subjects the shift pulses R1 and R2 to NAND processing and then inverts the result to thereby output the intermediate pulse B. Thus, in the present invention, the dummy shift register stage is added, whereby the normal intermediate pulses A, B . . . can be outputted from a start of a vertical scan. Thereafter the first stage of the output gate circuit unit subjects the intermediate pulse A and the clock pulse Half 2VCK to NAND processing and then inverts the result to thereby output the first drive pulse P1. Similarly, the first stage of the output gate circuit unit subjects the intermediate pulse A and the clock pulse Half 2VCKX to NAND processing and then inverts the result to thereby output the second drive pulse P2. Similarly, the second stage of the output gate circuit unit subjects the intermediate pulse B and the clock pulses Half 2VCK and Half 2VCKX to gate processing, and thereby forms the third and fourth drive pulses P3 and P4.

Thus, in the present invention, the dummy additional stage is inserted in front of the shift register of the decoding type vertical driving circuit. Therefore the two-input NAND gate circuit forming the first stage of the intermediate gate circuit unit can receive the shift pulses from the dummy stage and the first stage of the shift register respectively, and can thus perform exactly the same operation as the second and succeeding stages of the intermediate gate circuit unit. The intermediate gate circuit unit can thereby output normal intermediate pulses A, B, C . . . sequentially from a start. Consequently, the output gate circuit unit can output the drive pulses P1, P2, P3, P4 . . . in a form of steps which pulses all have the same pulse width. The drive pulses P1, P2, P3, P4 . . . in the form of steps make it possible to coincide a start of writing of a video signal with timing of the gate drive pulse P1, thus eliminating the need for providing dummy pixels. In a case where a pixel pitch in a vertical direction (row direction) is 18 μm, for example, a portion 72 μm wide corresponding to four rows of dummy pixels conventionally required can be eliminated from a layout by using the driving method of the present invention. It is thereby possible to contribute to achieving a narrower frame.

Figure 3:
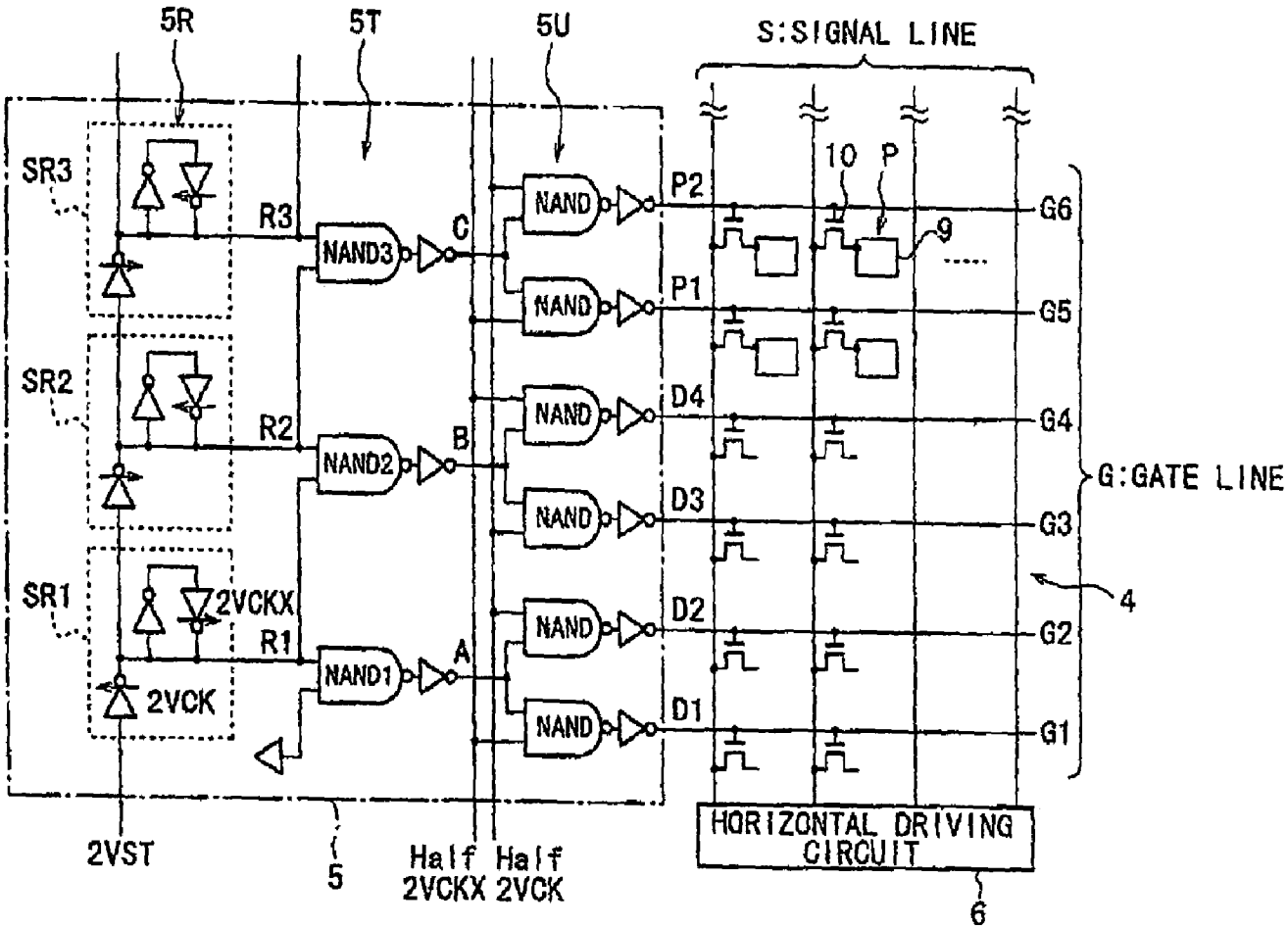
FIG. 3 is a circuit diagram showing a reference example of a display apparatus.

FIG. 3 shows a reference example of a display apparatus. Parts corresponding to those of the display apparatus according to the present invention as shown in FIG. 1 are identified by corresponding reference numerals. A vertical driving circuit 5 in the reference example of FIG. 3 has a different configuration than in FIG. 1 in that no dummy additional stage is provided at the front of a shift register 5R. Thus, a two-input NAND gate element NAND1 forming a first stage of an intermediate gate circuit unit 5T is in a different connected state than NAND gate elements NAND2 and NAND3 in a second and a succeeding stage. Specifically, one input terminal of the NAND gate element NAND1 placed in the first stage of the intermediate gate circuit unit 5T is supplied with a shift pulse R1 outputted from a corresponding stage (first stage SR1), whereas another input terminal does not receive a pulse to be supplied from a preceding shift stage and is therefore connected to a power supply line (H level), for example. As a result, an intermediate pulse A outputted from the first stage of the intermediate gate circuit unit 5T differs in waveform from intermediate pulses B, C . . . outputted from the second and succeeding stages. Affected by the intermediate pulse A outputted irregularly, an output gate circuit unit 5U connected to the intermediate gate circuit unit 5T cannot output normal drive pulses. As a result, the output gate circuit unit 5U supplies irregular drive pulses D1, D2, D3, and D4 to first four gate lines G1, G2, G3, and G4. Since rows of pixels P corresponding to the gate lines G1, G2, G3, and G4 are not selected correctly on a line-sequential basis, the horizontal driving circuit 6 cannot write a video signal properly. Therefore, first four rows of pixels P in the display apparatus in the reference example are made dummies without pixel electrodes. An effective display area is sacrificed by providing dummy pixel rows that do not contribute to display.

Figure 4:
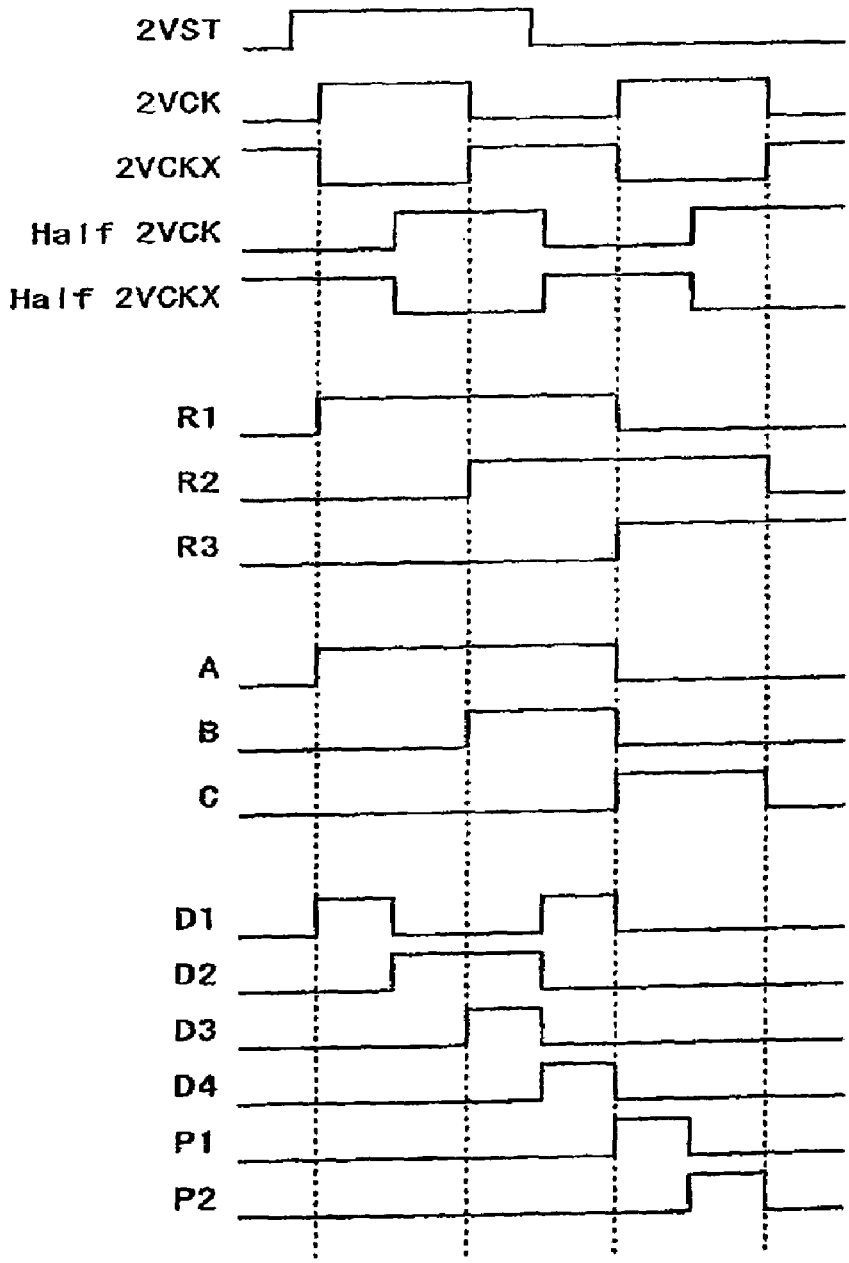
PRIOR ART F I G. 4
FIG. 4 is a timing chart of assistance in explaining operation of the reference display apparatus shown in FIG. 3.
Figure 5:
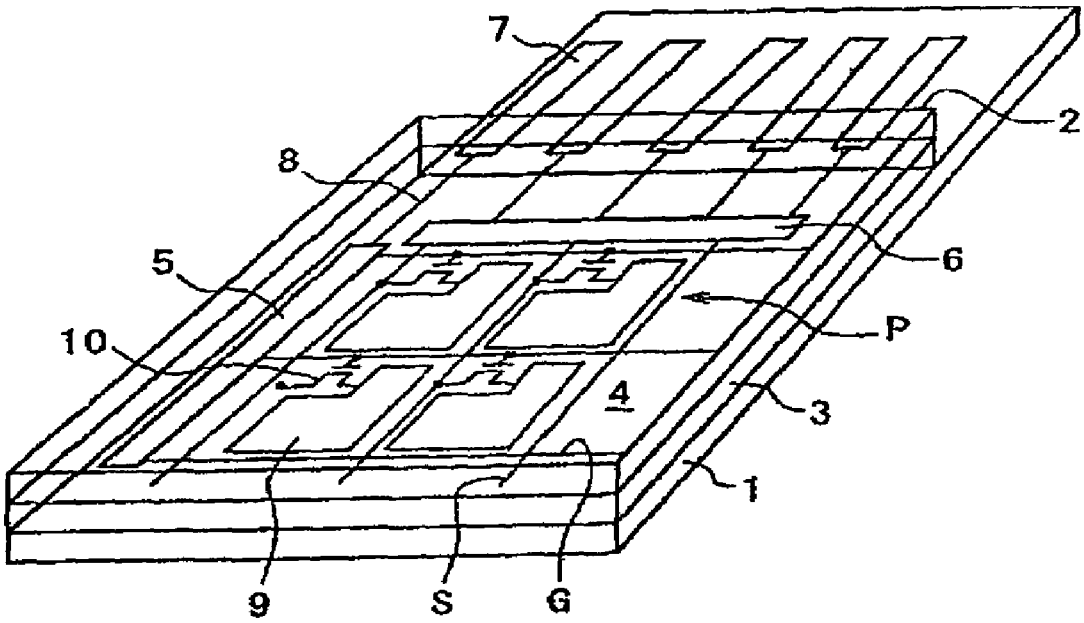
PRIOR ART F I G. 5
FIG. 5 is a schematic perspective view showing an example of a conventional display apparatus.

Operation of the reference display apparatus shown in FIG. 3 will be described with reference to a timing chart of FIG. 4. Pulses externally supplied to the vertical driving circuit are 2VST, 2VCK, 2VCKX, Half 2VCK, and Half 2VCKX, which are the same as in the timing chart of FIG. 2 illustrating the operation of the display apparatus according to the present invention. However, the shift register does not include a dummy stage, and therefore the shift register outputs shift pulses R1, R2, R3 . . . sequentially, starting in the first stage while one input terminal of the NAND gate element forming the first stage of the intermediate gate circuit unit is supplied with the shift pulse R1, another input terminal is maintained at the H level, as shown in FIG. 3. As a result, the first stage of the intermediate gate circuit unit outputs an intermediate pulse A having the same waveform as that of the shift pulse R1. On the other hand, the second stage of the intermediate gate circuit unit subjects the shift pulses R1 and R2 to NAND processing and then inverts the result to thereby output an intermediate pulse B. The following third stage of the intermediate gate circuit unit similarly subjects the shift pulses R2 and R3 to NAND processing and then inverts the result by an inverter to thereby form an intermediate pulse C. As is clear from the timing chart of FIG. 4, the first intermediate pulse A is different from the succeeding intermediate pulses B, C . . . .

The first stage of the output gate circuit unit subjects the intermediate pulse A and the clock pulse Half 2VCKX to NAND processing and then inverts the result to thereby output the drive pulse D1. As is clear from FIG. 4, the drive pulse D1 does not have a normal waveform, and has an irregular waveform including two pulses. The first stage of the output gate circuit unit similarly subjects the intermediate pulse A and the other clock pulse Half 2VCK to NAND processing and then inverts the result to thereby output the drive pulse D2. The drive pulse D2 has twice a normal pulse width, and thus has an irregular pulse waveform. Subsequently the second stage of the output gate circuit unit subjects the intermediate pulse B and the clock pulses Half 2VCKX and Half 2VCK to gate processing, and thereby forms the drive pulses D3 and D4. The drive pulses D3 and D4 should in themselves be normal pulses; however, since the drive pulses D3 and D4 coincide with the previously outputted drive pulses D1 and D2, the drive pulses D3 and D4 are not normal sequential outputs. Normal drive pulses P1 and P2 are not outputted until the third stage of the output gate circuit unit. Thus, the drive pulses D1 to D4 first outputted in the display apparatus of the reference example have different pulse widths and are not timed to form steps. For this reason, the display apparatus of the reference example deals with these irregular drive pulses D1 to D4 and then outputs a video signal. Therefore rows of dummy pixels corresponding to the drive pulses D1 to D4 are required.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A display apparatus comprising:

a pixel array unit including a plurality of gate lines, a plurality of signal lines, and pixels arranged in a form of a matrix at intersections of the gate lines and the signal lines;

a vertical driving circuit for sequentially selecting the pixels via the gate lines; and a horizontal driving circuit for writing a video signal to the selected pixels via the signal lines, said pixel array unit, said vertical driving circuit, and said horizontal driving circuit being disposed on an identical substrate;

wherein said vertical driving circuit includes:

a shift register having a multistage-connected structure with one stage corresponding to at least two gate lines, for sequentially outputting a shift pulse from each stage;

an intermediate gate circuit unit corresponding to each stage of the shift register, for processing a shift pulse of one stage and a shift pulse of a preceding stage and thereby generating a temporally separate intermediate pulse in each stage; and an output gate circuit unit corresponding to each stage of the intermediate gate circuit unit, and operating in response to an externally supplied clock pulse for processing the intermediate pulse outputted from each stage of the intermediate gate circuit unit and thereby sequentially outputting a drive pulse to two corresponding gate lines to sequentially select pixels;

wherein said shift register includes a dummy additional stage disposed in front of the first stage thereof, and a shift pulse outputted from the additional stage is supplied to a first stage of the intermediate gate circuit unit which stage corresponds to the first stage of the shift register;

wherein the shift register is driven by an externally supplied clock pulse having substantially the same frequency as the externally supplied clock pulse supplied to the output gate circuit unit; and wherein the externally supplied clock pulse supplied to the shift register is shifted 90° from the externally supplied clock pulse supplied to the output gate circuit unit.

2. The display apparatus as claimed in claim 1, wherein said output gate circuit unit processes the intermediate pulse outputted from the first stage of the intermediate gate circuit unit and outputs a normal drive pulse from a first gate line.

3. The display apparatus as claimed in claim 1, wherein said horizontal driving circuit writes a normal video signal from a pixel row corresponding to the first gate line, thus eliminating presence of rows of dummy pixels to which the normal video signal is not written.

4. The display apparatus as claimed in claim 1, wherein the externally supplied clock pulse driving the shift register has substantially the same duty ratio as the externally supplied clock pulse supplied to the output gate circuit unit.

5. The display apparatus as claimed in claim 1, wherein said intermediate gate circuit unit comprises at least a nand gate.

6. The display apparatus as claimed in claim 1, wherein said shift register is comprised of at least three inverters.

7. The display apparatus as claimed in claim 1, wherein the shift register is driven by a first and second externally supplied clock pulse, the second externally supplied clock pulse having an inverse relationship to the first clock pulse;

wherein the output gate circuit unit is driven by a third and fourth externally supplied clock pulse, the fourth externally supplied clock pulse having an inverse relationship to the third clock pulse, and wherein the third and fourth externally supplied clock pulses have substantially the same frequency as the first and second externally supplied clock pulses; and wherein the first externally supplied clock pulse supplied to the shift register is shifted 90° from the third externally supplied clock pulse supplied to the output gate circuit unit, and the second externally supplied clock pulse supplied to the shift register is shifted 90° from the fourth externally supplied clock pulse supplied to the output gate circuit unit.

8. A vertical driving circuit comprising:

a shift register having a multistage-connected structure for sequentially outputting a shift pulse from each stage;

an intermediate gate circuit unit corresponding to each stage of the shift register, for processing a shift pulse of one stage and a shift pulse of a preceding stage and thereby generating a temporally separate intermediate pulse in each stage; and an output gate circuit unit corresponding to each stage of the intermediate gate circuit unit, and operating in response to an externally supplied clock pulse for processing the intermediate pulse outputted from each stage of the intermediate gate circuit unit and thereby sequentially outputting one or more drive pulses;

wherein said shift register includes a dummy additional stage disposed in front of the first stage thereof, and a shift pulse outputted from the additional stage is supplied to a first stage of the intermediate gate circuit unit which stage corresponds to the first stage of the shift register;

wherein the shift register is driven by an externally supplied clock pulse having substantially the same frequency as the externally supplied clock pulse supplied to the output gate circuit unit; and wherein the externally supplied clock pulse supplied to the shift register is shifted 90° from the externally supplied clock pulse supplied to the output gate circuit unit.

9. The vertical driving circuit as claimed in claim 8, wherein the externally supplied clock pulse driving the shift register has substantially the same duty ratio as the externally supplied clock pulse supplied to the output gate circuit unit.

10. The vertical driving circuit as claimed in claim 8, wherein said intermediate gate circuit unit comprises at least a nand gate.

11. The vertical driving circuit as claimed in claim 8, wherein said shift register is comprised of at least three inverters.

12. The vertical driving circuit as claimed in claim 8, wherein the shift register is driven by a first and second externally supplied clock pulse, the second externally supplied clock pulse having an inverse relationship to the first clock pulse;

wherein the output gate circuit unit is driven by a third and fourth externally supplied clock pulse, the fourth externally supplied clock pulse having an inverse relationship to the third clock pulse, and wherein the third and fourth externally supplied clock pulses have substantially the same frequency as the first and second externally supplied clock pulses; and wherein the first externally supplied clock pulse supplied to the shift register is shifted 90° from the third externally supplied clock pulse supplied to the output gate circuit unit, and the second externally supplied clock pulse supplied to the shift register is shifted 90° from the fourth externally supplied clock pulse supplied to the output gate circuit unit.

13. A display apparatus comprising:

a pixel array unit including a plurality of gate lines, a plurality of signal lines, and pixels arranged in a form of a matrix at intersections of the gate lines and the signal lines;

a vertical driving circuit for sequentially selecting the pixels via the gate lines; and a horizontal driving circuit for writing a video signal to the selected pixels via the signal lines;

wherein said vertical driving circuit includes:

a shift register, supplied with a clock pulse, and having a multistage-connected structure with one stage corresponding to at least two gate lines, for sequentially outputting a shift pulse from each stage;

an intermediate gate circuit unit corresponding to each stage of the shift register, for processing a shift pulse of one stage and a shift pulse of a preceding stage and thereby generating an intermediate pulse in each stage; and an output gate circuit unit corresponding to each stage of the intermediate gate circuit unit, and operating in response to a clock pulse for processing the intermediate pulse outputted from each stage of the intermediate gate circuit unit and thereby sequentially outputting a drive pulse to two corresponding gate lines to sequentially select pixels;

wherein said shift register includes a dummy additional stage disposed in front of the first stage thereof, and a shift pulse outputted from the additional stage is supplied to a first stage of the intermediate gate circuit unit which stage corresponds to the first stage of the shift register; and wherein the clock pulse supplied to the shift register is shifted 90° from the clock pulse supplied to the output gate circuit unit.

14. The display apparatus according to claim 13, wherein the clock pulse supplied to the shift register has substantially the same frequency as the clock pulse supplied to the output gate circuit unit.

15. A display apparatus comprising:

a pixel array unit including a plurality of gate lines, a plurality of signal lines, and pixels arranged in a form of a matrix at intersections of the gate lines and the signal lines;

a vertical driving circuit for sequentially selecting the pixels via the gate lines; and a horizontal driving circuit for writing a video signal to the selected pixels via the signal lines;

wherein said vertical driving circuit includes:

a shift register having a multistage-connected structure with one stage corresponding to at least two gate lines, for sequentially outputting a shift pulse from each stage, and such that the shift register is driven by a first and second clock pulse, the second clock pulse having an inverse relationship to the first clock pulse;

an intermediate gate circuit unit corresponding to each stage of the shift register, for processing a shift pulse of one stage and a shift pulse of a preceding stage and thereby generating an intermediate pulse in each stage; and an output gate circuit unit corresponding to each stage of the intermediate gate circuit unit, and operating in response to a third and fourth clock pulse for processing the intermediate pulse outputted from each stage of the intermediate gate circuit unit and thereby sequentially outputting a drive pulse to two corresponding gate lines to sequentially select pixels, the fourth clock pulse having an inverse relationship to the third clock pulse, wherein said shift register includes a dummy additional stage disposed in front of the first stage thereof, and a shift pulse outputted from the additional stage is supplied to a first stage of the intermediate gate circuit unit which stage corresponds to the first stage of the shift register; and wherein the first clock pulse supplied to the shift register is shifted 90° from the third clock pulse supplied to the output gate circuit unit, and the second clock pulse supplied to the shift register is shifted 90° from the fourth clock pulse supplied to the output gate circuit unit.

16. The display apparatus according to claim 15, wherein the third and fourth clock pulses have substantially the same frequency as the first and second clock pulses.

* * * * *